US005399010A

United States Patent [19]

McClung et al.

[11] Patent Number: 5,399,010

[45] Date of Patent: Mar. 21, 1995

[54] FLIPPER DOOR

[75] Inventors: Duane G. McClung, Kalamazoo; Paul G. Dame, Holland, both of Mich.

[73] Assignee: Herman Miller, Inc., Zeeland, Mich.

[21] Appl. No.: 982,705

[22] Filed: Dec. 1, 1992

[51] Int. Cl.[6] ..... A47B 88/00

[52] U.S. Cl. ..... 312/334.1; 312/332; 312/322

[58] Field of Search ..... 312/331, 332, 322, 323, 312/321, 109–110; 211/27, 94; 108/40, 140

[56] References Cited

U.S. PATENT DOCUMENTS

| | | | |
|---|---|---|---|
| 726,957 | 5/1903 | Macey . | |
| 2,723,177 | 11/1955 | Belew | 312/322 |
| 3,339,995 | 9/1967 | Bencene | 312/322 |
| 3,748,005 | 7/1973 | Chovanec et al. | 312/109 |
| 3,794,401 | 2/1974 | Dean et al. | 312/331 X |
| 3,857,618 | 12/1974 | Hagen et al. | 312/331 X |
| 4,265,502 | 5/1981 | Blodee et al. | 312/109 |
| 4,324,439 | 4/1982 | Hagen et al. . | |
| 4,591,214 | 5/1986 | Reuter et al. | 312/110 |
| 4,600,254 | 7/1986 | Whalen | 312/323 |
| 4,615,570 | 10/1986 | Goodman | 312/110 |
| 4,641,896 | 2/1987 | Iimura et al. | 312/110 |
| 4,925,285 | 5/1990 | Ludwig et al. | 312/323 |

FOREIGN PATENT DOCUMENTS 2306206 8/1974 Germany .

*Primary Examiner*—Stephen C. Pellegrino
*Assistant Examiner*—Nancy Mulcare
*Attorney, Agent, or Firm*—Willian Brinks Hofer Gilson & Lione

[57] ABSTRACT

A flipper door mechanism for allowing a door to be moved between a closed position and an open position comprising a door and a support having a first surface and a second surface. The door is opened and closed by a movement device which is attached to the door by an attachment device. The movement device comprises 1) a pivoting device to pivot the door between the closed position and the open position and vice versa; 2) an engagement device to engage the first surface of the support; and 3) a guide to engage the second surface so that when the door is pivoted between the closed position and the open position the engagement device and the guide translationally move along the support to a retracted position.

40 Claims, 5 Drawing Sheets

FLIPPER DOOR

BACKGROUND OF THE INVENTION

Field of the Invention

This invention relates to a flipper door which is capable of pivoting from a closed position to an open position in which the door is in non-retracted position. The door is capable of translationally moving from the open but non-retracted position to an open and retracted position.

Discussion of Related Art

Prior art flipper doors are typically used to provide access to the interior of a cabinet. Some designs include pinion gears attached to the door to allow the door to pivot to an open and horizontal position. Such pinion gears engage horizontal racks attached to the side walls of the cabinet. The pinion gears move along the racks resulting in the door being retracted into the cabinet. However, such prior art flipper doors can experience racking in which each pinion gear moves along the racks at different rates with respect to each other. This causes one side of the door to enter the cabinet faster than the other side of the door causing the door to jam against the side walls of the cabinet.

Another example of a flipper door is shown in U.S. Pat. No. 4,265,502 to Blodee et al. describes a cabinet employing a flipper door. The flipper door comprises a planar covering sheet such that when it is in a vertical position it covers the cabinet opening. The covering sheet has two pinions which are connected to a rod. The pinions are positioned on racks so as to provide a support for the covering sheet. To expose the cabinet opening, one pivots the covering sheet about the pinions and the rod to a horizontal position. The covering sheet is then pushed inwardly resulting in the pinions and the covering sheet moving along the racks to a position inside the cabinet.

U.S. Pat. No. 4,591,214 to Reuter et al. describes a cabinet door assembly comprising horizontal tracks mounted to each side wall of a cabinet. A panel is attached by hinges to tubing which encompasses an equalizer rod having spur gears attached to each end thereof. The panel covers the opening created by the cabinet when in a vertical position. As in Blodee et al., one uncovers the opening by pivoting the panel about the hinge until the panel is in a horizontal position. The panel is pushed from the horizontal position into the cabinet via the gears traveling along racks.

U.S. Pat. No. 4,600,254 to Whalen describes a flipper door using idler wheels which engage a surface integral with and above a rack.

U.S. Pat. No. 4,615,570 to Goodman describes a flipper door which is attached to an axle via links and brackets which are directly attached to the axle and door, respectively. The links and brackets are coupled to each other so as to couple the door to the axle. An end of the axle and a stud shaft move along a pair of channels which are located above a rack. Once the axle end and stud shaft make contact with the ends of the channels, the links allow the pivot axis of the flipper door to be shifted forwardly to enable the door to close over the front edges of the side walls of the cabinet.

SUMMARY OF THE INVENTION

The present invention involves a flipper door mechanism for allowing a door to be moved between a closed position and an open position comprising a door and a support having a first surface and a second surface. The door is opened and closed by a movement device which is attached to the door by an attachment device. The movement device comprises 1) a pivoting device to pivot the door between the closed position and the open position; 2) an engagement device to engage the first surface of the support; and 3) a guide to engage the second surface so that when the door is pivoted between the closed position and the open position the engagement device and the guide translationally move along the support to a retracted position.

The present invention presents many advantages such as it allows for the cabinet top to be used for a working surface when the door is opened and retracts below the cabinet top surface.

The present invention provides a rack and pinion design which reduces racking of the flipper door during opening, closing and retracting movements of the door. The reduction of racking enables the door to enter the cabinet more evenly so that both sides of the door are fully retracted into the cabinet at substantially the same time.

The present invention provides an aesthetically pleasing device in which the flipper door can be retracted fully into the cabinet interior.

DESCRIPTION OF THE PREFERRED EMBODIMENT

Figure 1A:
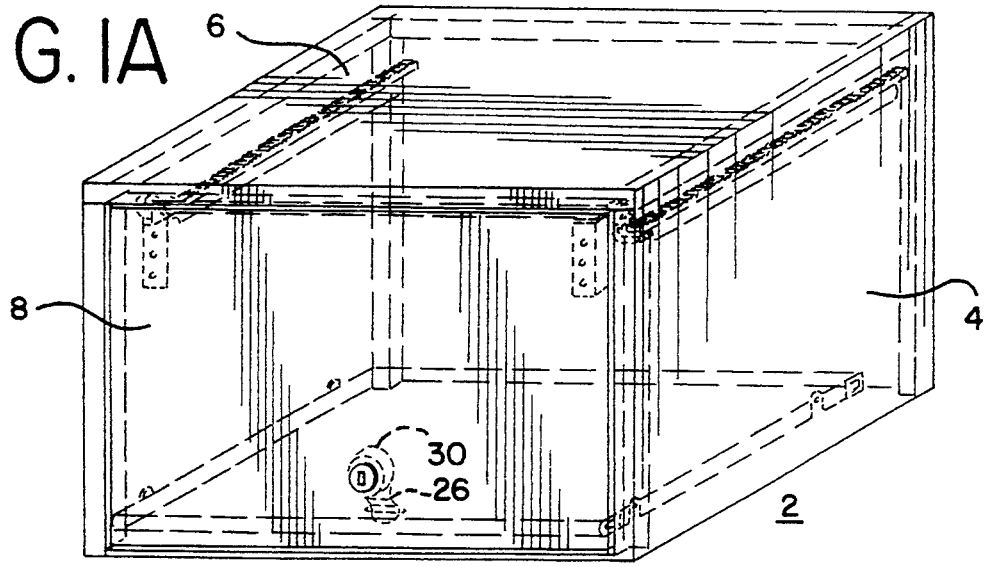
FIG. 1A is a perspective view of a cabinet employing an embodiment of the present invention when the door is in a closed position.
Figure 1B:
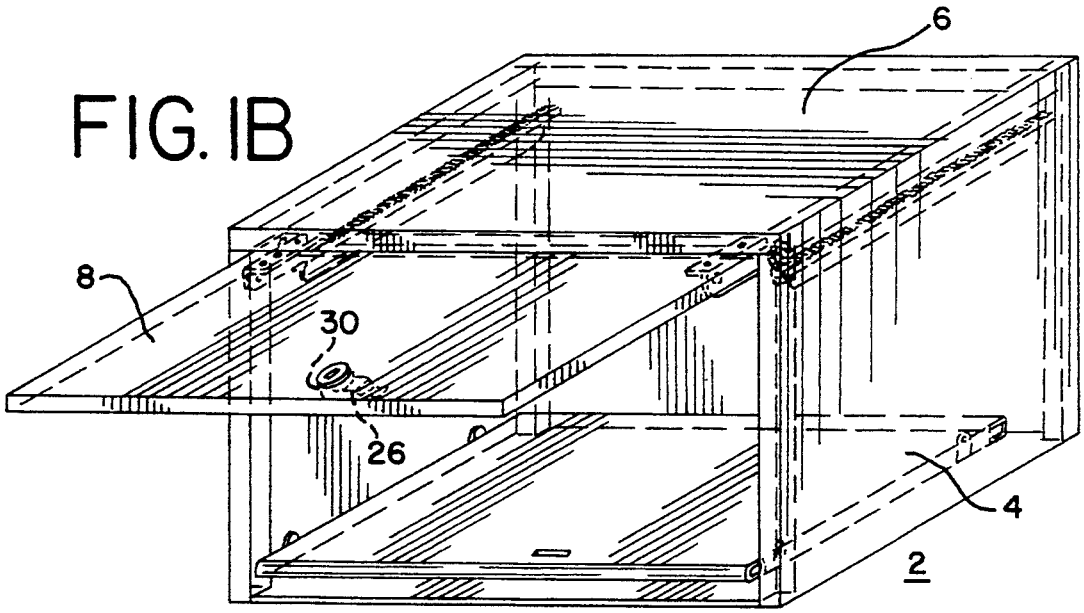
FIG. 1B is a perspective view of a cabinet employing an embodiment of the present invention when the door is opened but not in a retracted position.
Figure 1C:
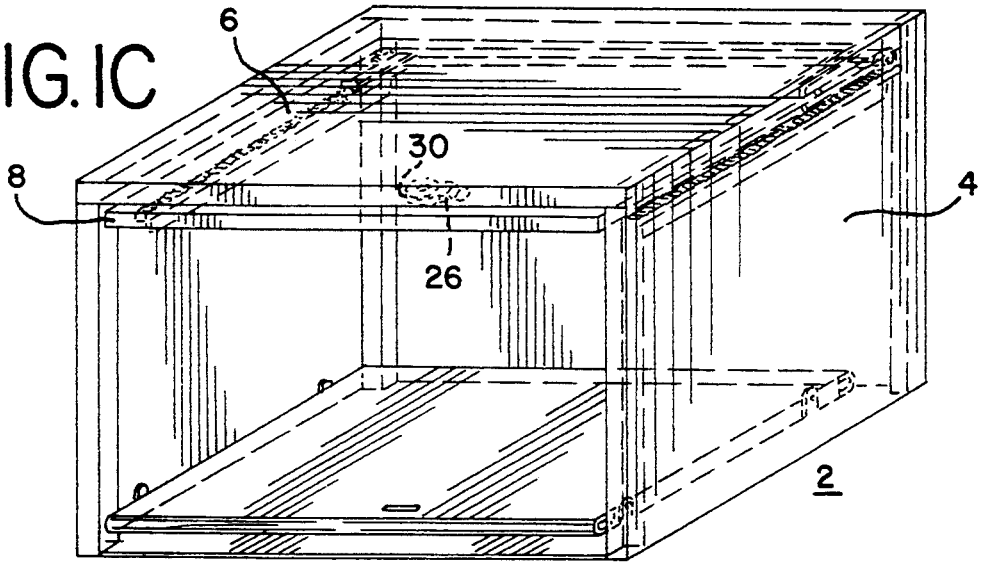
FIG. 1C is a perspective view of a cabinet employing an embodiment of the present invention when the door is opened and is in a retracted position.

A preferred embodiment of the present flipper door mounting mechanism invention is illustrated in FIGS. 1A–C and 2–7. In FIGS. 1A–C, the various movements of the flipper door mounting mechanism are shown. The flipper door mounting mechanism of the present invention preferably is employed with a cabinet having one or more drawers. The cabinet may either be a separate entity or in combination with a paneling system such as The Spot System commercialized by Herman Miller, Incorporated. As seen in FIGS. 1A–C, the cabinet 2 comprises a pair of parallel side walls 4, a top wall 6, and a door 8. The cabinet 2 further comprises a rear wall 10 which, in one embodiment, is a panel of a paneling system to which side and top walls 4 and 6, respectively, are attached. In another embodiment, rear wall 10 is a separate independent piece attached to the side and top walls 4 and 6. Attached to side walls 4 is a bottom shelf 12 (FIG. 2) which allows various items to be supported thereon. Bottom shelf 12 comprises a substantially horizontal rectangular surface 14 and a pair of downwardly extending vertical side flanges 16. Each vertical side flange 16 comprises two or more aligned connectors 18 spaced from each other. Connectors 18 have openings 20 which are aligned with corresponding openings 22 located on each side wall 4 so that bottom shelf 12 is attached to side walls 4 by inserting well known attachment devices, such as nuts and bolts, through both openings 20 and 22.

Door 8 is used to either allow or deny entrance to those items supported on bottom shelf 12. Preferably, walls 4, 6, 10, door 8, and bottom shelf 12 are made of a structurally sound material, such as steel, wood, particle board, or plastic. Furthermore, the walls, door, and shelf are substantially rectangular wherein their dimensions are chosen so as to enable one to store such items as file folders.

Figure 2:
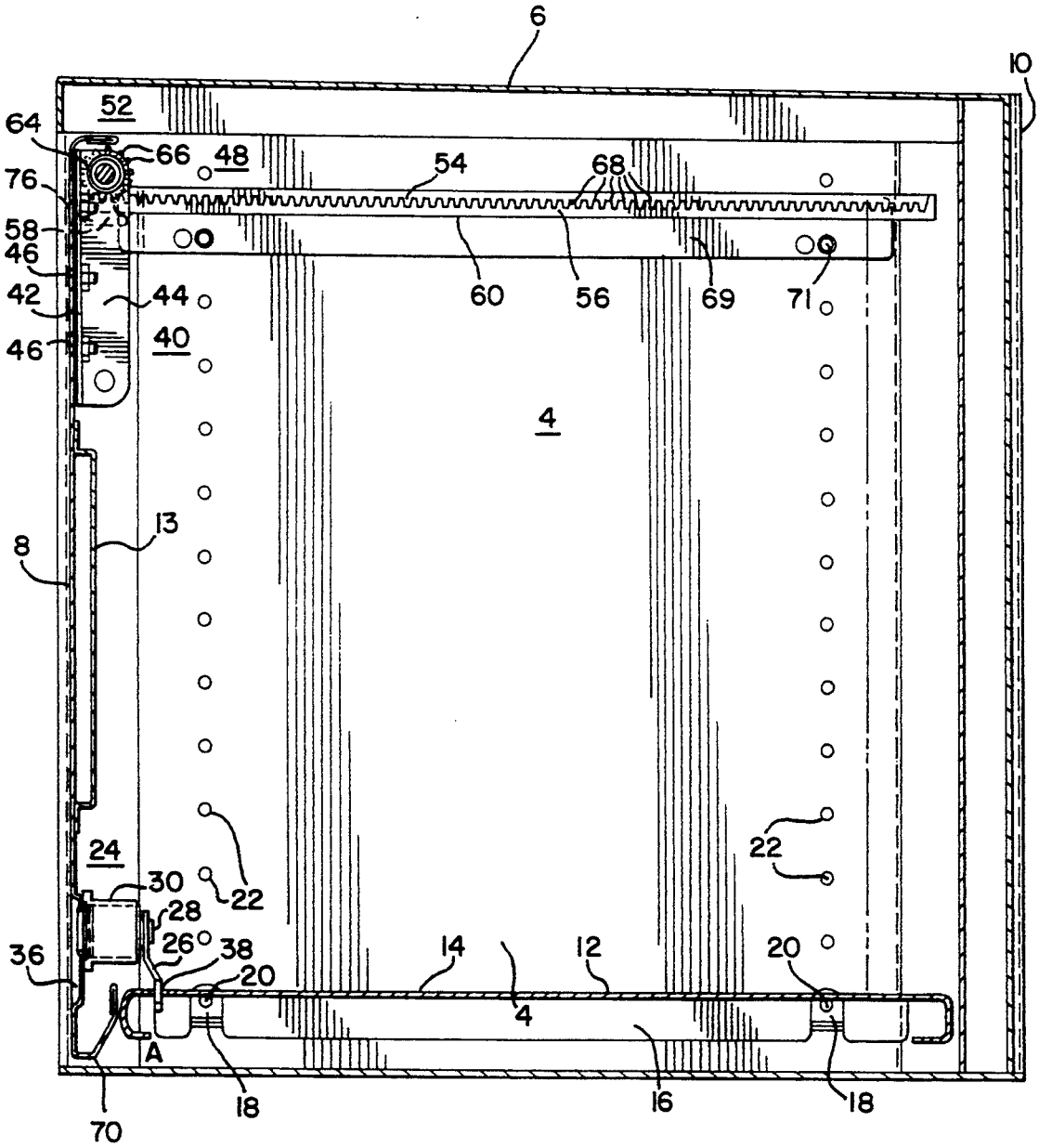
FIG. 2 is a side cross-sectional view of the interior of the cabinet of FIG. 1A when the door is in the closed position.
Figure 3:
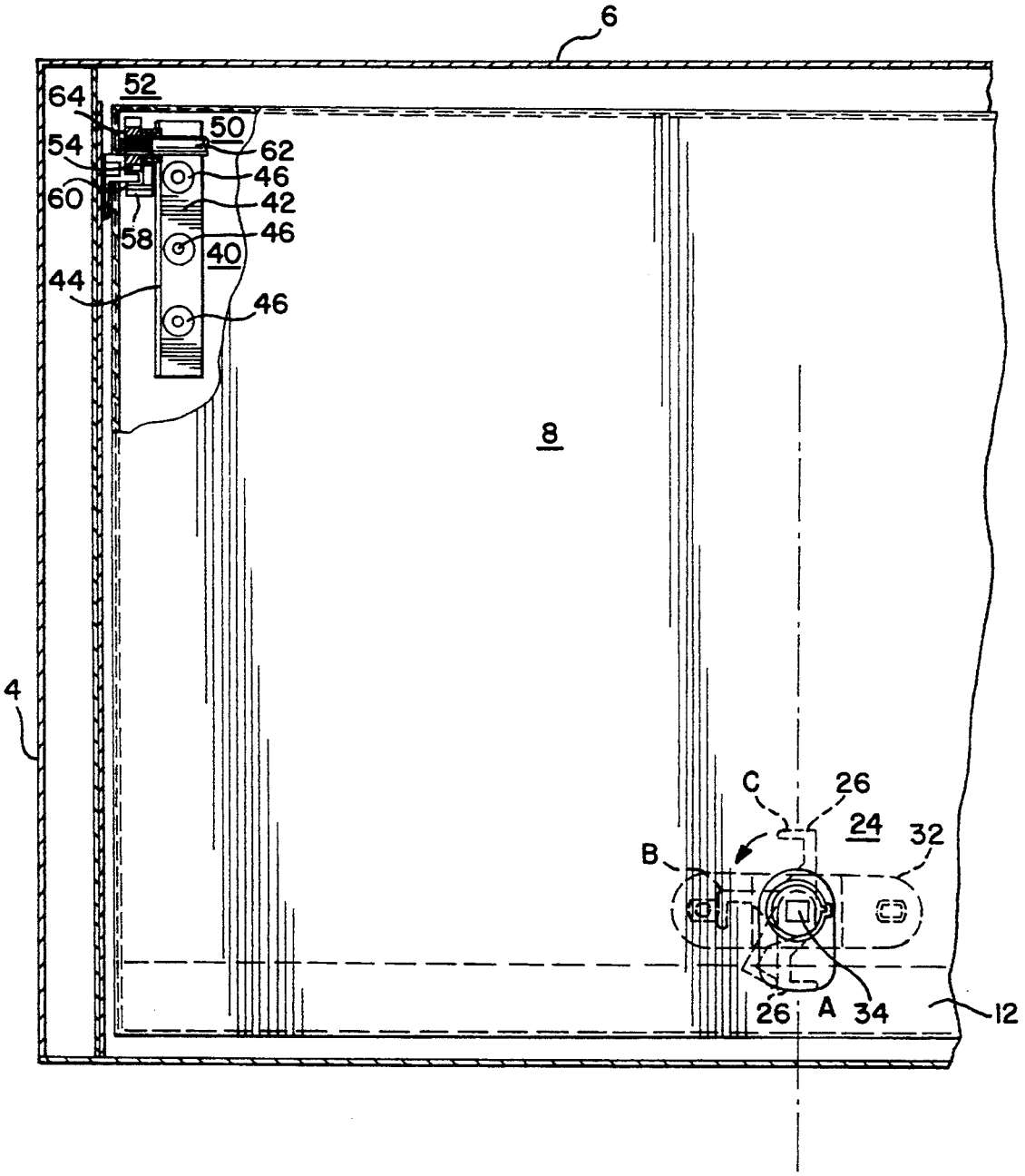
FIG. 3 is a front cross-sectional view of the interior of the cabinet of FIGS. 1A and 2 when the door is in the closed position.

As illustrated in FIGS. 1A, 2, and 3, door 8 is in a closed vertical position in which door 8 blocks access to the interior of cabinet 2 defined by side walls 4, top wall 6, rear wall 10, and bottom shelf 12. Side walls 4 and rear wall 10 may comprise two sheets of material spaced from one another. Door 8 preferably comprises a single sheet of material with a piece 13 attached to the inside surface for structural rigidity. A locking mechanism 24 for locking the door 8 in the closed position is attached to the side of the door 8 facing the interior of the cabinet 2. Locking mechanism 24 comprises a locking piece 26, an axle 28, a bearing support 30, a bracket 32, and a handle or knob 34. Locking piece 26 is substantially L-shaped and has an opening to allow one end of axle 28 to be inserted therethrough and attached thereto in a well known manner, such as welding. Axle 28 is rotationally supported by bearing support 30 in a well known manner, such as bearings. Bearing support 30 is attached to door 8 through the use of bracket 32 which is attached to the door 8 in a well known manner such as nuts and bolts. At the position of attachment of the bearing support 30, door 8 comprises an indented area 36 which contains an opening to receive the other end of axle 28. A handle or knob 34 is attached to the other end of axle 28 so that by rotating the knob 34 counterclockwise to position A, L-shaped locking piece 26 engages a slot 38 located in surface 14 of shelf 12, as shown by the arrow and phantom lines of locking piece 26 shown in FIG. 3. Thus, door 8 is prevented from pivoting from its closed position. Furthermore, clockwise rotation of knob 34 to positions B or C (FIG. 3) results in unlocking the door 8 and allowing the door 8 to be opened by a pivoting motion.

When knob 34 is rotated to an unlocking position, door 8 is capable of performing a pivoting motion through the use of an attachment device such as a pair of brackets 40 attached to the upper left and right-hand corners of the interior facing side of door 8. Each bracket 40 comprises a mounting piece 42 and a pivoting piece 44 which are arranged at approximately right angles with respect to each other. Preferably, mounting piece 42 and pivoting piece 44 are made from the same piece of material, such as steel or plastic. Mounting piece 42 preferably is substantially rectangular in shape having a thickness of approximately 16 gauge steel, a length of approximately $4\frac{1}{4}''$, and a width of approximately $\frac{3}{4}''$. Mounting piece 42 furthermore has one or more openings arranged along its length and which are aligned with corresponding holes in door 8 so that attachment of mounting piece 42 directly against door 8 is accomplished by well known means, such as nuts and bolts 46. Preferably, pivoting piece 44 is arranged to be nearer the side edge of door 8 than mounting piece 42 as seen in FIG. 3.

Pivoting piece 44 preferably is substantially rectangular in shape having a thickness of approximately 16 gauge steel, length of approximately $4\frac{1}{4}''$, and a width of approximately 1". An opening is cut out of pivoting piece 42 which preferably is circular having a diameter of approximately 0.690" and which is located approximately 0.160" from the top of pivoting piece 42. Furthermore, the openings of each pivoting piece 44 are aligned with each other.

The above-described brackets 40 allow for a movement device 48 to be attached to the door 8 to allow for pivoting and translational movement. Movement device 48 comprises 1) a pivoting device 50 to pivot door 8 from the closed position to an open position (FIG. 1B) and vice versa; 2) an engagement device 52 to engage a first surface 54 of a support such as horizontal rack 56; and 3) a guide 58 to engage a second surface 60 of rack 56. In the preferred embodiment of FIGS. 1–7, the door 8 pivots about a horizontal-axis. However, the invention is equally capable of providing a flipper door which pivots about a vertical axis positioned near a side wall 4 of cabinet 2. In such an embodiment the door 8 pivots towards the side wall 4 nearest the vertical axis until the door 8 is parallel to the side walls 4. The door 8 is then retracted into cabinet 2 along the side wall 4. In such an embodiment the flipper door mechanism of FIGS. 1–7 would preferably mounted to the top wall 6 and shelf 12.

Pivoting device 50 preferably comprises a horizontal carrier rod 62 made of such materials as steel or plastic, wherein each end of carrier rod 62 is inserted through the opening of a corresponding pivoting piece 44. Thus, door 8 is allowed to pivot about carrier rod 62 so as to move from the vertical position to the horizontal position and vice versa.

Engagement device 52 has a structure such that it interacts with a first surface of support 56 such that engagement device 52 moves along the support. Engagement device 52 preferably comprises a pinion gear 64 permanently and non-rotatively attached to each end of carrier rod 62 in a well known manner so that the pinion gear 64 and carrier rod 62 rotatively engage rack 56. In addition, each pinion gear is identical in shape and are oriented exactly the same way at each end of carrier rod 62. Each pinion gear 64 preferably is substantially disc-like in shape having a thickness of approximately 0.880" and a diameter of approximately 0.860". Furthermore, each pinion gear 64 preferably is made of a plastic, such as Delrin 500 CL and comprises twelve teeth 66. However, it is possible to change the diameter and number of teeth of pinion gear 64 to alter the rate of translational movement of door 8.

Figure 6:
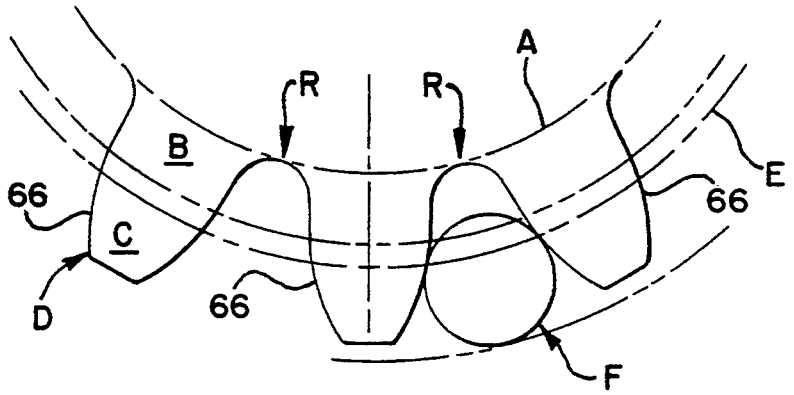
FIG. 6 is an enlarged view of an embodiment of a pinion gear to be used with the invention of FIGS. 1–5.

As shown in FIG. 6, each tooth 66 preferably has a full depth involute shape wherein each tooth is separated by spaces having a root end R. The diameter of the circle A intersecting the root ends R is approximately 0.594". Each tooth 66 comprises a cylindrical-like base B and a conical-like top piece C having a flat top surface D.

The boundary at which base B and top piece C forms along a circle E (whose center coincides with the center of the gear 64) having a diameter of approximately 0.750". The arcuate length of the thickness of each tooth as measured along circle E is approximately 0.098". The diameter of a measuring pin F positioned between adjacent teeth and which makes contact with the teeth at the boundary has a diameter of approximately 0.110" and a measurement across the pin of approximately 0.902–0.908". The circular pitch between two corresponding points of adjacent teeth is approximately 0.196". Furthermore, the gear 64 has a diametrical pitch of approximately 16, a pressure angle of approximately 20°, a whole depth of approximately 0.1406", a base circle of approximately 0.713", and a backlash pet pair of approximately 0.005–0.007".

It is understood that other shapes for teeth 66 are possible, such as triangular or circular or that the top piece C may be more rounded at the top.

Teeth 66 engage complementarily arranged teeth 68 located on rack 56 which is preferably made of plastic or 13% glass filled nylon. Preferably, each rack 56 has the same number of teeth 68 so that even translational movement for the door 8 is accomplished. Rack 56 should have each tooth 68 located at a position along side wall 4 which substantially corresponds to a tooth 68 of the other rack which is positioned along the other side wall 4. Furthermore, teeth 68 of rack 56 which are engaged by pinion gear 64 should exactly correspond to those teeth 68 on the other rack 56 which are engaged by the other pinion gear 64.

Rack 56 is attached to a bracket 69 which has openings 71 that are aligned with openings 22 of side wall 4. Bracket 69 is attached to side wall 4 by using well known means such as nuts and bolts inserted through aligned openings 22 and 71. Though FIGS. 2–5 illustrate the embodiment where teeth 68 are located on the top surface 54 of rack 56, it is also possible to have pinion gear teeth 66 engage teeth 68 located on the bottom surface 60 of rack 56. In the embodiment where teeth 68 are located on the top surface 54, bottom surface 60 is substantially flat or planar. Likewise, when teeth 68 are at the bottom surface 60, top surface 54 is substantially flat or planar.

Figure 5:
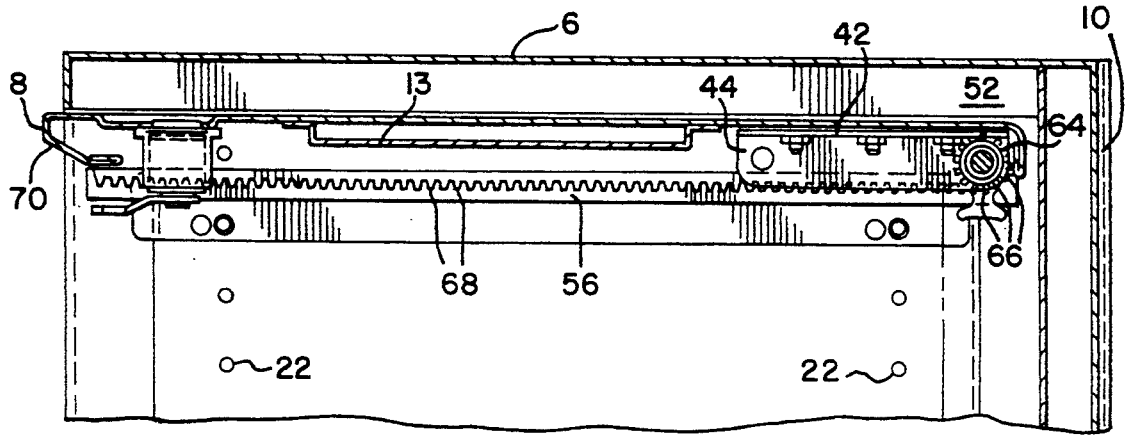
FIG. 5 is a side cross-sectional view of the interior of the cabinet of FIG. 1C when the door is in the open and retracted position.
Figure 4:
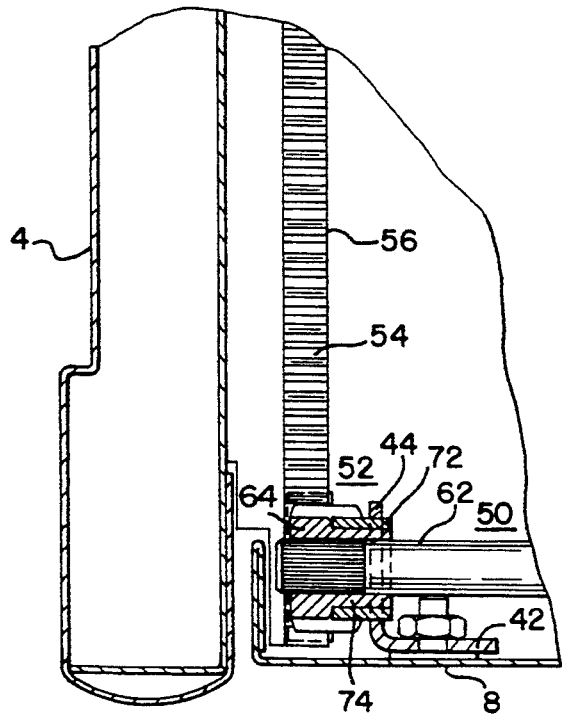
FIG. 4 is a top cross-sectional view of the interior of the cabinet of FIGS. 1A, 2, and 3 when the door is in the closed position.

Thus, when door 8 is pivoted to the open horizontal position as shown in FIG. 1B, door 8 is retracted into cabinet 2 by pushing the bottom end of door 8. Pushing door 8 results in teeth 66 and 68 engaging each other so that pinion gear 54 rotates along rack 56. Since door 8 is attached to pinion gear 54 through bracket 40, door 8 will translationally move in a horizontal direction into cabinet 2 until it is almost fully retracted, as shown in FIGS. 1C and 5. During the translational movement of door 8, pinion gears 64 synchronously move with respect to each other. Thus, the above-described arrangement in concert with guide 58 prevents racking and enables both side edges of the door 8 to be fully retracted into the cabinet 2 at the same time.

Figure 7A:
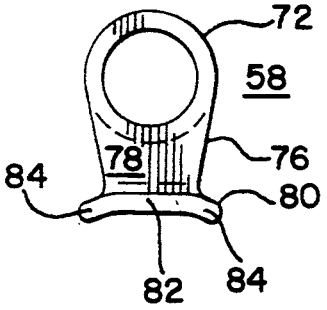
FIG. 7A is a front view of an embodiment of a guide to be used with the invention of FIGS. 1–5.
Figure 7B:
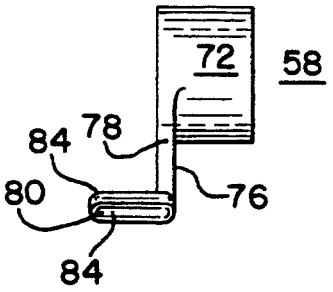
FIG. 7B is a side view of the embodiment of the guide of FIG. 7A.

A guide 58 as shown in FIGS. 3 and 7A–B is attached to pinion gear 64 to avoid having pinion gear 64 leave rack 56 during pivoting or translational motion of door 8. Guide 58 preferably comprises an annular portion 72 which engages the exterior surface of an annular hub portion 74 of pinion gear 64 and also engages the interior surface of the opening of the pivoting piece 44. Annular hub portion 74 has a length of approximately 0.500", an inside diameter of approximately 0.313" and an outside diameter of approximately 0.499". Furthermore, annular portion 72 has a length of approximately 0.50", an inside diameter of approximately 0.501" and an outside diameter of approximately 0.688" so that a snug fit is formed between the opening of the pivoting piece 44, annular portion 72 and annular hub portion 74. The snug fit further allows carrier rod 62 and pinion gear 64 to rotate with respect to annular portion 72.

Attached to annular portion 72 of guide 58 is a substantially L-shaped guide piece 76. Guide piece 76 has a vertical portion 78 that extends downward from annular portion 72 by approximately 0.352" to position a horizontal-like portion 80 slightly below the bottom surface 60 of rack 56 as shown in FIGS. 2 and 3. In another embodiment, horizontal-like portion 80 makes contact with bottom surface 60. Horizontal-like portion 80 is attached to and protrudes approximately perpendicular to the end of vertical portion 78. Portion 80 preferably has a thickness of approximately 0.094" and has a flat portion 82 and two ends 84. The ends 84 of horizontal-like portion 80 are separated by approximately 0.750" and are each angled downwardly by approximately 25°. The two ends 84 are joined to each other by a flat portion 82 having a length of approximately 0.266" as measured along the rack.

Preferably, annular portion 72 and guide piece 76 are made from the same material, such as nylon. In the embodiment of the top surface 54 being substantially flat or planar, the orientation of guide 58 would be reversed so that guide piece 76 would engage top surface 54. In both embodiments, guide 58 provides improved stability during the pivoting and translational movement of the door 8.

The foregoing description is provided to illustrate the invention, and is not to be construed as a limitation. Numerous additions, substitutions and other changes can be made to the invention without departing from its scope as set forth in the appended claims.

We claim:

1. A flipper door mechanism for allowing a door to be moved between a closed position and an open position comprising:

a wall having an edge;

a door;

a support attached to said wall, extending along said wall at an angle with respect to said edge and having a first surface and a second surface facing away from each other;

a movement device attached to said door and in contact with said support, wherein said movement device comprises 1) a pivoting device to allow said door to be pivoted between said closed position and said open position, 2) an engagement device engaging said first surface of said support, and 3) a guide positioned, adjacent said second surface;

said support lies between said engagement device and said guide, said movement device structured so that said door is pivoted between said closed position and said open position and when said door is at said open position said engagement device and said guide translationally move along said support to a retracted position and;

said door is substantially aligned with said edge at said closed position and substantially aligned with said support at said open position.

2. The flipper door mechanism of claim 1, wherein said first surface of said support comprises teeth.

3. The flipper door mechanism of claim 2, wherein said second surface of said support comprises a substantially planar surface.

4. The flipper door mechanism of claim 2, comprising an attachment device for attaching said movement device to said door, wherein said attachment device comprises an opening and wherein said pivoting device comprises a carrier rod inserted through said opening allowing said door to pivot about said carrier rod.

5. The flipper door mechanism of claim 4, wherein said movement device further comprises a pinion gear attached to an end of said carrier rod and wherein said pinion gear engages said first surface of said support.

6. The flipper door mechanism of claim 1, comprising an attachment device for attaching said movement device to said door, wherein said attachment device comprises an opening and wherein said pivoting device comprises a carrier rod inserted through said opening allowing said door to pivot about said carrier rod.

7. The flipper door mechanism of claim 1, wherein said second surface of said support comprises teeth.

8. The flipper door mechanism of claim 7, wherein said first surface of said support comprises a substantially planar surface.

9. The flipper door mechanism of claim 7, comprising an attachment device for attaching said movement device to said door, wherein said attachment device comprises an opening and wherein said pivoting device comprises a carrier rod inserted through said opening allowing said door to pivot about said carrier rod.

10. The flipper door mechanism of claim 9, wherein said movement device further comprises a pinion gear non-rotatively attached to an end of said carrier rod and wherein said pinion gear engages said first surface of said support.

11. The flipper door mechanism of claim 1, wherein said door pivots about an axis parallel to said wall.

12. The flipper door mechanism of claim 1, wherein said door pivots about an axis perpendicular to said wall.

13. The flipper door mechanism of claim 1, wherein said door pivots about an axis parallel to said wall.

14. The flipper door mechanism of claim 1, wherein said door pivots about an axis perpendicular to said wall.

15. A flipper door mechanism for allowing a door to be moved between a closed position and an open position comprising:

a wall having an edge;

a door;

a support attached to said wall, extending along said wall at an angle with respect to said edge and having a first surface and a second surface;

a movement device, wherein said movement device comprises 1) a pivoting device comprising a carrier rod to allow said door to be pivoted about said carrier rod between said closed position and said open position, 2) an engagement device comprising a pinion gear non-rotatively attached to an end of said carrier rod and engaging said first surface of said support, and 3) a guide engaging said second surface so that said door is pivoted between said closed position and said open position and when said door is at said open position said engagement device and said guide translationally move along said support; and a bracket attached to said door comprising a mounting piece attached to said door and a pivoting piece arranged at approximately right angles with respect to each other, said pivoting piece having an opening in which said carrier rod is inserted therethrough; and said door is substantially aligned with said edge in said closed position and substantially aligned with said support in said open position.

16. The flipper door of claim 15, wherein said first surface of said support comprises teeth.

17. The flipper door of claim 16, wherein said second surface of said support comprises a substantially planar surface.

18. The flipper door of claim 15, wherein said second surface of said support comprises teeth.

19. The flipper door of claim 18, wherein said first surface of said support comprises a substantially planar surface.

20. The flipper door of claim 18, wherein said pivoting piece comprises an opening and wherein said pivoting device comprises a carrier rod inserted through said opening allowing said door to pivot about said carrier rod.

21. The flipper door of claim 20, wherein said movement device further comprises a pinion gear non-rotatively attached to an end of said carrier rod and wherein said pinion gear engages said second surface of said support.

22. A flipper door mechanism for allowing a door to be moved between a closed position and an open position comprising:

a first side wall;

a second side wall, wherein said first side wall and said second side wall define a space therebetween;

a door at the closed position enclosing the space between the pair of side walls;

a first rack attached to said first side wall and having a first top surface having teeth and a second bottom surface which is substantially planar wherein said first top surface and said second bottom surface face away from each other;

a second rack attached to said second side wall and positioned parallel to said first rack, wherein said second rack comprises a first top surface having teeth and a second bottom surface which is substantially planar;

a carrier rod having a first end rind a second end, wherein a first pinion gear is attached to said first end and a second pinion gear is attached to said second end;

said carrier rod is rotatively attached to said door and is positioned such that said first pinion gear engages said first surface of said first rack and said second pinion gear engages said first surface of said second rack so that said door pivots between said closed position and said open position;

a first guide positioned adjacent said second bottom surface of said first rack, wherein said first rack lies between said first pinion gear and said first guide so that said door is pivoted between said closed position and said open position said carrier rod, and when said door is at said open position said first guide and said door translationally move along said first rack to a retracted position.

23. The flipper door mechanism of claim 22, wherein said door pivots about a horizontal axis.

24. The flipper door mechanism of claim 22, wherein said door pivots about a vertical axis.

25. The flipper door mechanism of claim 22, comprising a second guide positioned adjacent said second bottom surface of said second rack so that when said door is pivoted between said closed position and said open position said carrier rod, said second guide and said door translationally move along said second rack to a retracted position.

26. A flipper door mechanism for allowing a door to be moved between a closed position and an open position comprising:

a wall having an edge;

a door;

a support attached to said wall, extending along said wall at an angle with respect to said edge and having a top surface and a bottom surface;

a movement device, wherein said movement device comprises 1) a pivoting device allowing said door to be pivoted between said closed position and said open position, 2) an engagement device engaging said top surface of said support, and 3) a guide engaging said bottom surface so that said door is pivoted between said closed position and said open position and when said door is at said open position said engagement device and said guide translationally move along said support; and an L-shaped bracket having a first leg and a second leg arranged at approximately right angles with respect to each other, said first leg lies parallel to and adjacent to said door and is mounted to said door, said second leg lies perpendicular to and adjacent said door and supports said pivoting device; and said door is substantially aligned with said edge in said closed position and substantially aligned with said support in said open position.

27. A flipper door mechanism for allowing a door to be moved between a closed position and an open position comprising:

a top wall;

a bottom wall;

a side wall positioned between and attached to said top and bottom walls, wherein said top wall, said bottom wall and said side wall define a space therebetween;

a door at the closed position enclosing the space between the top and bottom walls;

a first rack attached to said top wall and having a top surface having teeth and a bottom surface which is substantially planar;

a second rack attached to said bottom wall and positioned parallel to said first rack, wherein said second rack comprises a top surface having teeth and a bottom surface which is substantially planar;

a carrier rod having a first end and a second end, wherein a first pinion gear is attached to said first end and a second pinion gear is attached to said second end;

said carrier rod is rotatively attached to said door and is positioned such that said first pinion gear engages said top surface of said first rack and said second pinion gear engages said top surface of said second rack so that said door pivots between said closed position and said open position;

a first guide positioned adjacent said bottom surface of said first rack, wherein said first rack lies between said first pinion gear and said first guide so that said door is pivoted between said closed position and said open position said carrier rod, and when said door is at said open position said first guide and said door translationally move along said first rack to a retracted position.

28. The flipper door mechanism of claim 26, wherein said door pivots about an axis perpendicular to said top wall.

29. The flipper door mechanism of claim 26, comprising a second guide positioned adjacent said bottom surface of said second rack so that when said door is pivoted between said closed position and said open position said carrier rod, said second guide and said door translationally move along said second rack to a retracted position.

30. A flipper door mechanism for allowing a door to be moved between a closed position and an open position comprising:

a first side wall;

a second side wall, wherein said first side wall and said second side wall define a space therebetween;

a door at the closed position enclosing the space between the pair of side walls;

a first rack attached to said first side wall and having a top surface having teeth and a bottom surface which is substantially planar;

a second rack attached to said second side wall and positioned parallel to said first rack, wherein said second rack comprises a top surface having teeth and a bottom surface which is substantially planar;

a carrier rod having a first end and a second end, wherein a first pinion gear is attached to said first end and a second pinion gear is attached to said second end;

said carrier rod is rotatively attached to said door and is positioned such that said first pinion gear engages said top surface of said first rack and said second pinion gear engages said top surface of said second rack so that said door pivots between said closed position and said open position;

an L-shaped guide extending from said first pinion gear and defining a space, said first rack located within said space, said guide is positioned adjacent said bottom surface of said first rack, so that said door is pivoted between said closed position and said open position said carrier rod, and when said door is at said open position said first guide and said door translationally move along said first rack to a retracted position.

31. The flipper door mechanism of claim 30, wherein said top surface of said support comprises teeth.

32. The flipper door mechanism of claim 30, wherein said bottom surface of said support comprises teeth.

33. The flipper door mechanism of claim 30, wherein said door pivots about an axis parallel to said first side wall.

34. The flipper door mechanism of claim 30, wherein said door pivots about an axis perpendicular to said first side wall.

35. A flipper door mechanism for allowing a door to be moved between a closed position and an open position comprising:

a first side wall;

a second side wall, wherein said first side wall and said second side wall define a space therebetween;

a door at the closed position enclosing the space between the pair of side walls;

a first rack attached to said first side wall and having a top surface having teeth and a bottom surface which is substantially planar;

a second rack attached to said second side wall and positioned parallel to said first rack, wherein said second rack comprises a top surface having teeth and a bottom surface which is substantially planar;

a carrier rod having a first end and a second end, wherein a first pinion gear is attached to said first end and a second pinion gear is attached to said second end;

said carrier rod is rotatively attached to said door and is positioned such that said first pinion gear engages said top surface of said first rack and said second pinion gear engages said top surface of said second rack so that said door pivots between said closed position and said open position;

a guide having a first portion and a second potion extending from said first pinion gear, wherein said first and second portions are attached to each other and define a space therebetween, said first rack located within said space, said guide is positioned adjacent said second surface of said first rack, so that said door is pivoted between said closed position and said open position said carrier rod, and when said door is at said open position said first guide and said door translationally move along said first rack to a retracted position.

36. The flipper door mechanism of claim 35, wherein said top surface of said support comprises teeth.

37. The flipper door mechanism of claim 35, wherein said bottom surface of said support comprises teeth.

38. The flipper door mechanism of claim 35, wherein said door pivots about an axis parallel to said first side wall.

39. The flipper door mechanism of claim 35, wherein said door pivots about an axis perpendicular to said first side wall.

40. A method of preventing racking of a flipper door while being moved from an open position to a retracted position within a space defined between a first side wall and a second side wall and vice versa, said first side wall having attached thereto a first rack having a top surface having teeth and a bottom surface which is substantially planar; said second side wall having attached thereto a second rack having a top surface having teeth and a bottom surface which is substantially planar; and a carrier rod having a first end and a second end, wherein a first pinion gear is attached to said first end and engages said teeth of said first rack and a second pinion gear is attached to said second end and engages said teeth of said second rack; said method comprising the steps of:

positioning said door substantially parallel to said first rack and said second rack;

imparting a force on said door so that first and second pinion gears rotate relative to said top surfaces of said respective first and second racks so that said door translationally moves relative to said first and second racks;

preventing racking of said door during said translational movement by positioning a guide adjacent to said bottom surface of said first rack, wherein said support lies between said first pinion gear and said guide.

* * * * *

UNITED STATES PATENT AND TRADEMARK OFFICE

CERTIFICATE OF CORRECTION

PATENT NO. : 5,399,010
DATED : March 21, 1995
INVENTOR(S) : Duane G. McClung et al.

It is certified that error appears in the above-indentified patent and that said Letters Patent is hereby corrected as shown below:

In the Claims Column 8,

In Claim 22, line 47, delete "rind" and substitute --and--.

Signed and Sealed this

Twenty-sixth Day of September, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,399,010
DATED : March 21, 1995
INVENTOR(S) : Duane G. McClung et al.

It is certified that error appears in the above-indentified patent and that said Letters Patent is hereby corrected as shown below:

In the Claims

Claim 22, column 8, line 61 insert "by" after "position".

Claim 27, column 9, line 67 insert "by" after "position".

Claim 30, column 10, line 44 insert "by" after "position".

Claim 35, column 11, line 22 insert "by" after "position".

Claim 35, column 11, line 20 replace "second" with --bottom--.

Signed and Sealed this

Thirty-first Day of December, 1996

Bruce Lehman

*Attest:*

BRUCE LEHMAN

*Attesting Officer*

*Commissioner of Patents and Trademarks*